United States Patent [19]

Sundheim

[11] 4,095,309

[45] Jun. 20, 1978

[54] APPARATUS FOR CLEANING A CARPET

[75] Inventor: John J. Sundheim, Englewood, Colo.

[73] Assignee: John J. Sundheim Family Estate, Englewood, Colo.

[21] Appl. No.: 616,547

[22] Filed: Sep. 25, 1975

[51] Int. Cl.[2] ..... A47L 7/00

[52] U.S. Cl. ..... 15/320; 15/324; 15/322; 15/374; 15/380; 15/420

[58] Field of Search ..... 15/320, 321, 322, 374, 15/380, 393, 420; 180/8 B, 8 BA, 8 C

[56] References Cited

U.S. PATENT DOCUMENTS

| | | | |
|---|---|---|---|
| 1,160,031 | 11/1915 | Adams | 15/320 X |
| 1,472,208 | 10/1923 | Dawer | 15/320 |
| 1,791,760 | 2/1931 | Kline | 15/420 |
| 1,953,350 | 4/1934 | Kitto | 15/380 |
| 1,953,616 | 4/1934 | Kitto | 15/380 |
| 2,731,659 | 1/1956 | Coplen | 15/380 X |
| 3,699,607 | 10/1972 | Putt | 15/320 |

*Primary Examiner*—Christopher K. Moore
*Attorney, Agent, or Firm*—Burton & Dorr

[57] ABSTRACT

Apparatus for cleaning a carpet using a cleaning fluid and a reciprocating head member that contacts the carpet. The cleaning fluid is applied to the carpet through a slot in the reciprocating head member. The head member further includes scrubbing means and vacuum means that are reciprocated with the cleaning fluid slot. The drive means for the reciprocating head member moves the head member back and forth along the same path at a rate of about 125 to about 585 cycles per minute. The slot for the cleaning fluid is fixedly spaced from the inlet to the vacuum means and the head member is reciprocated a distance greater than the spacing between the slot and the inlet to the vacuum means. The drive means in this embodiment is part of a body member whose mass is sufficiently greater than that of the head member so that when the drive means reciprocates the head member at a high rate, the distance moved by the head member is greater than the distance moved by the body member. In one embodiment, the body member is held off the carpet and only the head member is touching the carpet. In all of the embodiments, the high rate of reciprocation of the head member results in there being only a small frictional force between the carpet and the head member. In one embodiment, the scrubbing means on the head member includes V-shaped lands and grooves inclined to the direction of reciprocating motion. In another embodiment, the scrubbing means includes scallop-shaped recesses. The apparatus of this invention is self-propelling in a direction from the head member toward the body member. The head member is reciprocally moved by the drive means in a first direction away from the body member. As it moves in this first direction, the head member engages the carpet. Further movement of the head member away from the body member serves to accelerate the body member in a direction opposite to the first direction and propels the head and body members in the second direction.

13 Claims, 29 Drawing Figures

APPARATUS FOR CLEANING A CARPET

FIELD OF THE INVENTION

This invention relates to a method and apparatus for cleaning a carpet, a method for propelling an apparatus across a carpet, a system for propelling an apparatus across a carpet, and a handle system for a self-propelled apparatus.

BACKGROUND OF THE INVENTION

Many methods and apparatuses have been previously used in cleaning a carpet, however, each of these methods and apparatuses have been disadvantageous for one or more reasons. One reason has been the inability to remove effectively soiling material which has become adhered to the fibers or lodged at the base of the fibers or become entrapped within the loops of the fibers of the pile of the carpet, without subjecting the carpet either to excessive wear or undesirable distortion of the fibers or using unnecessarily strong cleaning liquids. Another reason is the inability to remove effectively a large portion of the cleaning liquid which has been applied to the carpet thereby precluding rapid drying of the carpet following cleaning thereof. Another reason is the inability to leave the fibers of the carpet in a uniform, eye pleasing arrangement. Another reason is the inability to manufacture an inexpensive system for self-propelling an apparatus across a carpet. Another reason is the difficulty of controlling easily and readily a relatively heavy apparatus which, during operation thereof, produces relatively large reactive forces that are transmitted to the handle of the apparatus. Illustrative prior art methods and apparatuses are shown, for example, in U.S. Pat. Nos. 1,929,345, 2,531,370, 2,635,278, 2,843,866, 2,844,840, 2,909,800, 2,932,844, 2,999,258, 3,477,088, 3,594,849, 3,616,482, 3,619,849, 3,624,668 and 3,805,319 and German Pat. No. 569,799.

SUMMARY OF THE INVENTION

This invention provides a new and novel apparatus for efficiently cleaning a carpet using a cleaning fluid. This invention also provides a new and novel system for propelling an apparatus.

A cleaning liquid, such as water and which may contain detergents or other similar cleansing material, is applied to the carpet. Following application of the cleaning liquid, or simultaneously with the application thereof, soiling material is loosened from the carpet and entrained in the cleaning liquid by reciprocating a carpet engaging surface portion along the surface of the treated portion of the carpet to scrub the fibers of the pile of the carpet. The carpet engaging surface portion is reciprocated in a predetermined direction, i.e., in a direction generally parallel with the direction of movement of the apparatus across the carpet. The reciprocatory movement of said carpet engaging surface aligns the fibers of the pile of the carpet while simultaneously pivoting said fibers about a point adjacent their lower ends. The fibers are also rotated about their longitudinal axis in a general oscillatory fashion as a result of the reciprocatory movement of said carpet engaging surface portion. A portion of the loosened soiling material and liquid previously applied to the carpet is removed by subjecting the fibers of the pile of the carpet to a pressure less than the ambient pressure.

It is a principal object of this invention to provide a unique and novel apparatus for cleaning a carpet through the use of a cleaning liquid, including a foam material.

It is another object of this invention to provide a system for self-propelling an apparatus across a carpet.

It is also another object of this invention to provide a handle system for easily and quickly controlling the direction of movement of an apparatus across a supporting surface.

Another object of this invention is to provide a carpet cleaning apparatus constructed for a movement across a carpet in a predetermined direction, said apparatus comprising means for loosening the soiling material from the carpet, said soiling material loosening means including means for applying a cleaning liquid to a portion of the carpet, and means for scrubbing the fibers of the pile of the carpet, said scrubbing means having a fiber engaging surface portion for engaging the fibers of the pile of the carpet, said scrubbing means being mounted for reciprocatory movement across the fibers of the pile of the carpet in a direction generally parallel with said predetermined direction, means for cleaning the carpet by subjecting the scrubbed fibers of the pile of the carpet to a pressure less than ambient pressure thereby removing from the fibers at least a portion of the loosened soiling material and the cleaning liquid, and means for reciprocating said fiber scrubbing means across the fibers of the pile of the carpet in a direction generally parallel with said predetermined direction, said carpet cleaning means and said soiling material loosening means being longitudinally spaced one from the other taken in a direction generally parallel with the longitudinal axis of said predetermined direction.

Another object of this invention is to provide a carpet cleaning apparatus as aforesaid wherein said carpet cleaning means is mounted for reciprocatory movement across a carpet in a direction generally parallel with said predetermined direction, said apparatus including means for reciprocating said carpet cleaning means in a direction generally parallel with said predetermined direction.

Another object of this invention is to provide a carpet cleaning apparatus as aforedescribed, including means for simultaneously reciprocating the scrubbing means of said soiling material loosening means and said carpet cleaning means.

Another object of this invention is to provide an apparatus as aforedescribed wherein said scrubbing means includes a lower surface portion having a slot formed therethrough for conveying a cleaning liquid to a portion of said slot, said slot having a longitudinal axis disposed generally normal to said predetermined direction, said scrubbing means including segmental V-shaped lands and grooves formed in the lower surface portion along one side of said slot and extending generally parallel with the longitudinal axis of said slot, said V-shaped lands and grooves having the apex of the middle segmental V-shaped land and groove disposed along one side of said slot at the middle portion thereof.

Another object of this invention is to provide an apparatus as aforedescribed in which the segmental V-shaped lands and grooves form an included angle with the longitudinal axis of the slot formed in the lower surface portion of said scrubbing means varying between approximately 10° and 20°.

Another object of this invention is to provide an apparatus as aforedescribed in which the segmental V-shaped lands and grooves form an included angle with the longitudinal axis of the slot formed in the lower surface portion of said scrubbing means equal to approximately 20°.

Another object of this invention is to provide an apparatus as aforedescribed in which said scrubbing means includes segmental V-shaped lands and grooves formed in the lower surface portion along opposite sides of said slot and extending generally parallel with the longitudinal axis of said slot.

Another object of this invention is to provide an apparatus as aforedescribed including a second means for cleaning the carpet by subjecting a portion of the carpet to a pressure less than the ambient pressure, said second carpet cleaning means being longitudinally spaced apart from said soiling material loosening means.

Another object of this invention is to provide an apparatus as aforedescribed in which the carpet cleaning means includes a lower surface portion having a slot formed therethrough and through which the loosened soiling material and cleaning liquid passes upon being removed from the fibers of the carpet, said slot having a longitudinal axis disposed generally normal to said predetermined direction, said lower surface portion of said carpet cleaning means having a pair of grooves formed therein, one each of said pair of grooves extending longitudinally along one of the sides of said slot and spaced apart from said slot.

Another object of this invention is to provide an apparatus as aforedescribed in which the soiling material loosening means includes a removable fiber scrubbing means.

Another object of this invention is to provide an apparatus as aforedescribed wherein said scrubbing means includes a lower surface portion having a slot formed therethrough for conveying a cleaning liquid to a portion of said slot, said slot having a longitudinal axis disposed generally normal to said predetermined direction, said scrubbing means including a plurality of scallop-shaped recesses formed in the lower surface portion along opposite sides of said slot.

Another object of this invention is to provide an apparatus as aforedescried in which the carpet cleaning means includes a lower surface portion having a slot formed therethrough and through which loosened soiling material and cleaning liquid passes upon being removed form the fibers of the carpet, said slot having a longitudinal axis disposed generally normal to said predetermined direction, said lower surface portion of said carpet cleaning means having a plurality of scallop-shaped recesses formed along one side of said slot.

Another object of this invention is to provide an apparatus as aforedescribed wherein said scrubbing means includes a lower surface portion having a slot formed therethrough for conveying a cleaning liquid to a portion of said slot, said slot having a longitudinal axis disposed generally normal to said predetermined direction, said lower surface portion having a pair of grooves formed therein, one each of said grooves extending longitudinally along one of the sides of said slot and spaced apart from said slot.

Another object of this invention is to provide an apparatus as aforedescribed in which the carpet cleaning means includes a lower surface portion having a slot formed therethrough and through which the loosened soiling material and cleaing liquid passes upon being removed from the fibers of the carpet, said slot having a longitudinal axis disposed generally normal to said predetermined direction, said lower surface portion of said carpet cleaning means having a pair of grooves formed therein, one each of said pair of grooves extending longitudinally along one of the sides of said slot and spaced apart from said slot.

Another object of this invention is to provide an apparatus as aforedescribed wherein said scrubbing means includes a lower surface portion having a slot formed therethrough for conveying a cleaning liquid to a portion of said slot, said slot having a longitudinal axis disposed generally normal to said predetermined direction, said scrubbing means including a plurality of recesses formed in the lower surface portion along opposite sides of said slot, said recesses being disposed in fluid communication with said slot.

Another object of this invention is to provide an apparatus as aforedescribed wherein said carpet cleaning means includes a lower surface portion having a slot formed therethrough and through which loosened soiling material and cleaning liquid passes upon being removed from the fibers of the carpet, said slot having a longitudinal axis disposed generally normal to said predetermined direction, said lower surface portion of said carpet cleaning means having a plurality of recesses formed along opposite sides of said slot, each recess being disposed in fluid communication with said slot.

Another object of this invention is to provide a carpet cleaning apparatus constructed for movement across a carpet in a predetermined direction, said apparatus having first and second parts at least one of which is moveable in a linear direction relative to the other, said apparatus comprising roller means for supporting the first part of said apparatus, a carpet engaging surface portion for supporting the second part of said apparatus, said second part being mounted for reciprocatory movement across the fibers of the pile of the carpet in a direction generally parallel with said predetermined direction, means for applying a cleaning liquid to a portion of the carpet, means formed on said carpet engaging surface portion for scrubbing the fibers of the pile of the carpet, means for cleaning the carpet by subjecting the fibers of the pile of the carpet to a pressure less than the ambient pressure thereby removing from the fibers at least a portion of the loosened soiling material and cleaning fluid, said carpet cleaning means and said scrubbing means being longitudinally spaced one from the other, taken in a direction generally parallel with the longitudinal axis of said predetermined direction, and means for propelling said apparatus across a carpet, said propelling means including means for applying a first force to the second part to move said second part relative to said first part in a linear direction until the carpet engaging surface portion of said second part engages the carpet to prevent further movement of said carpet engaging surface portion, said means continuing the application of said first force until the first part of said apparatus moves away from the second part by a predetermined amount, and said means further applying a second force to move the carpet engaging surface of said second part toward the first part.

Another object of this invention is to provide a system for propelling an aparatus across a carpet, said apparatus having first and second parts at least one of which is moveable in a linear direction relative to the other, said system comprising a carpet engaging surface for supporting the first part of said aparatus, roller means for supporting the second part of said apparatus, a means for propelling said apparatus across a carpet, said propelling means including means for applying a first force to the first part to move the first part relative to the second part in a linear direction until the carpet engaging surface of said first part engages the carpet to prevent further movement of said carpet engaging surface relative to the second part, said means continuing the application of said first force until the roller means supported part moves away from the carpet engaging surface supported part by a predetermined amount, and said means further applying a second force to move the carpet engaging surface supported part toward the roller means supported part.

Another object of this invention is to provide a system as aforedescribed, including means for sequentially applying said first and second forces at a rate of at least approximately 125 times per minute.

Another object of this invention is to provide a system as aforedescribed, including means for sequentially applying said first and second forces at a rate of at least approximately 585 times per minute.

Another object of this invention is to provide a system as aforedescribed in which the roller means includes a pair of wheels mounted adjacent one side of said roller means supported part.

Another object of this invention is to provide an apparatus for cleaning a carpet that applies a cleaning fluid to the carpet, scrubs the carpet to loosen soiling material, and removes the loosened soiling material and cleaning fluid therefrom by means of a vacuum. The apparatus has a reciprocating fiber engaging surface portion that repeatedly aligns the fibers of the pile of the carpet relative to each other and pivots the fibers about a point adjacent their lower ends.

Another object of this invention is to provide an apparatus which aligns and pivots the fibers of the pile of the carpet while simultaneously rotating the fibers about their longitudinal axis in an oscillatory manner.

Another object of this invention is to provide a system for propelling an apparatus across the carpet comprising an apparatus having two parts one of which is moveable in a linear direction relative to the other, one of said parts being supported by roller means and the other of said parts being supported by a carpet engaging surface. The apparatus propells itself across a carpet by a predetermined amount by applying a first force to move the carpet engaging surface supported part relative to the roller means supported part in a generally linear direction until the carpet engaging surface supported part engages the carpet with sufficient friction to prevent further movement of said carpet engaging surface supported part relative to the carpet, continuing the application of said first force until the roller means supported part moves away from the carpet engaging surface supported part by a predetermined amount, and applying a second force to move the carpet engaging surface supported part towards the roller means supported part, and continuing to propel said apparatus by repeating the propelling step.

Another object of this invention is to provide a system for propelling an apparatus across a carpet, said apparatus having first and second parts at least one of which is movable in a linear direction relative to the other, said system comprising a first part of said apparatus having a mass at least approximately 2½ times greater than the mass of the second part, means for supporting the second part of said apparatus on said carpet, said means including a carpet engaging surface portion, and means for propelling said apparatus across a carpet, said propelling means including means for applying a first force between said first and second parts to move said second part relative to the first part in a linear direction until the carpet engaging surface of said second part engages the carpet to prevent further movement of said carpet engaging surface relative to the second part, said means continuing the application of said first force until the first part moves away from the second part by a predetermined amount, and said means further applying a second force between said first and second parts to move the second part toward the first part.

Another object of this invention is to provide a system as aforedescribed in which the ratio of the mass of the first part to the second part is at least approximately 3½ times or more.

Another object of this invention is to provide in a carpet cleaning apparatus as aforedescribed a new and novel scrubbing means for cleaning the fibers of the pile of a carpet.

Other objects and features of this invention will become apparent by reference to the following specification and to the drawings.

DESCRIPTION OF THE PREFERRED EMBODIMENTS

Figure 1:
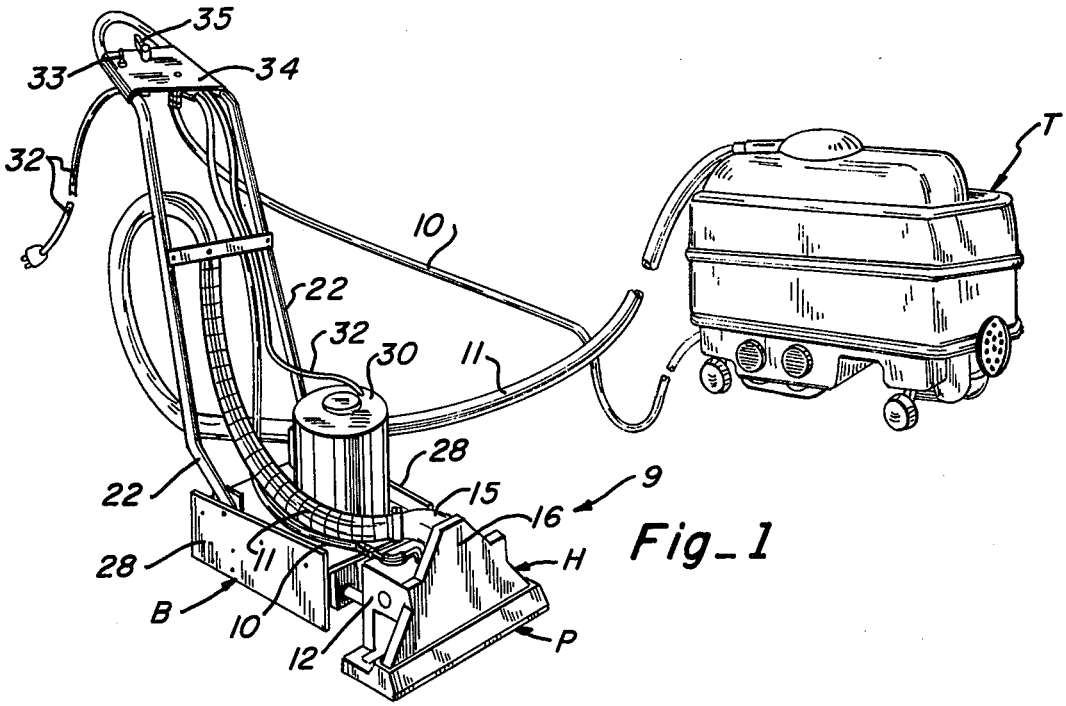
FIG. 1 is a perspective view of a carpet cleaning apparatus constructed in accordance with this invention.
Figure 2:
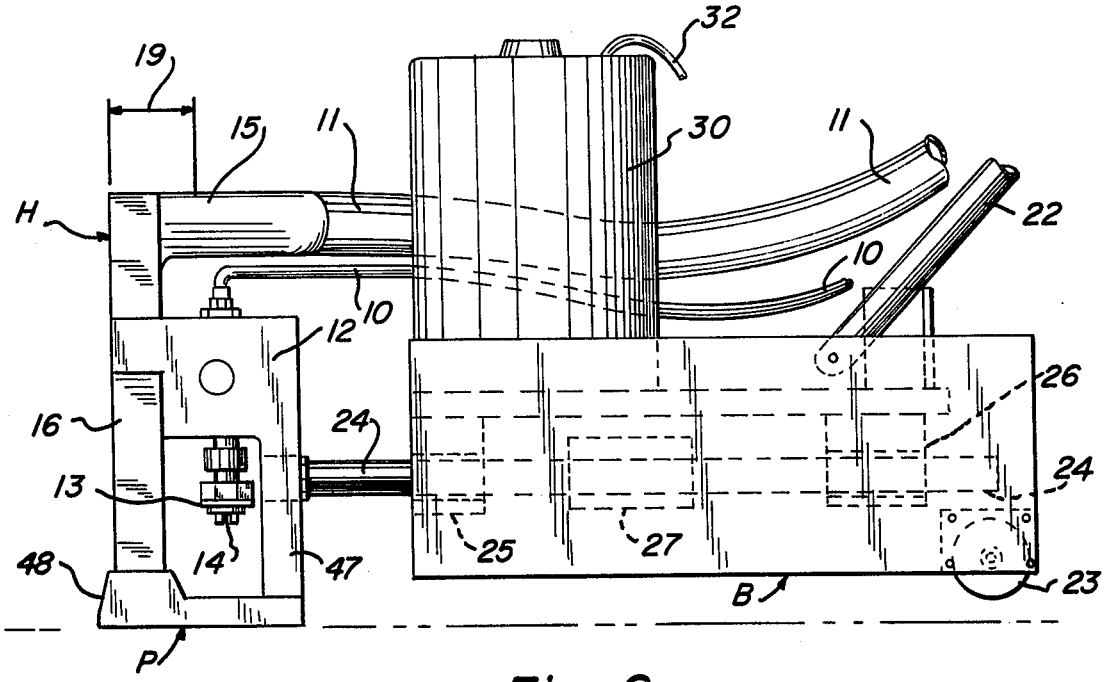
FIG. 2 is a side elevational view, on an enlarged scale, of a part of the carpet cleaning apparatus and showing the opposite side of that part shown in FIG. 1.

The method and apparatus of this invention is especially adapted for efficient cleaning of carpets through the use of a hot or cold cleaning liquid, or a foam, to which detergents, soap or the like have been added, and is particularly effective in loosening, entraining within the liquid and removing said loosened and entrained soiling material from the base of the carpet. The method and apparatus of this invention leaves the fibers of the pile of the carpet in an aesthetically arranged manner. The method and apparatus of this invention is particularly effective in cleaning a carpet without subjecting same to adverse abrasive wear or to strong cleaning liquids. The method and apparatus of this invention has been found to be effective in prolonging the normal life of a carpet by loosening and removing from the base thereof soiling material which heretofore has been difficult, if not impossible, to remove efficiently and without adversely affecting the material from which a carpet is made.

Referring now to the drawings and in particular to FIGS. 1–5, a carpet cleaning apparatus 9 is shown comprising a body B from which a head H is reciprocated, with a plate P, or carpet engaging means preferably removable from the head H, at the bottom of the head H, to provide a fiber engaging surface having a predetermined configuration such as lands and grooves, slots, recesses or the like, which engage and move the fibers of the pile to and fro in a parallel pivoting manner thereby creating paths of reduced resistance from the bottom part of the carpet to the upper surface of the carpet through which loosened soil material may more readily to travel. A hot water or "steam" hose 10 may extend to the head H from a suitable tank, such as tank T of FIG. 1, which is shown as a type of tank disclosed in my prior U.S. Pat. No. 3,821,820, although any other suitable tank may be utilized. A suction hole 11 also extends from the tank T to the head H. The hot water or "steam" hose 10 connects with a liquid manifold 12 from which a series of nozzles 13 depend, each being provided on the underside with a slot 14, so that a transversely extending, fan-like stream may issue from each nozzle. The suction hose 11 leads to a hose connector 15 extending angularly from the top of a transversely diverging, suction manifold 16 which is connected to a downwardly diverging suction slot 17 in plate P, as in FIG. 4. A slot 18 in the plate P permits direction of the sprays or jets from the nozzles 13 onto the carpet. The head H is reciprocated for a sufficient distance, such as indicated by the reciprocation arrow 19 of FIGS. 2 and 4, that the fibers of the pile of the carpet will not only be moved or pivoted forwardly and rearwardly by the plate P, but will also be generally aligned parallel to adjacent fibers while being scrubbed by the plate. The amplitude of reciprocation is preferably greater than the distance between the suction slot 17 and the line of impingement of the hot water sprays.

Figure 4:
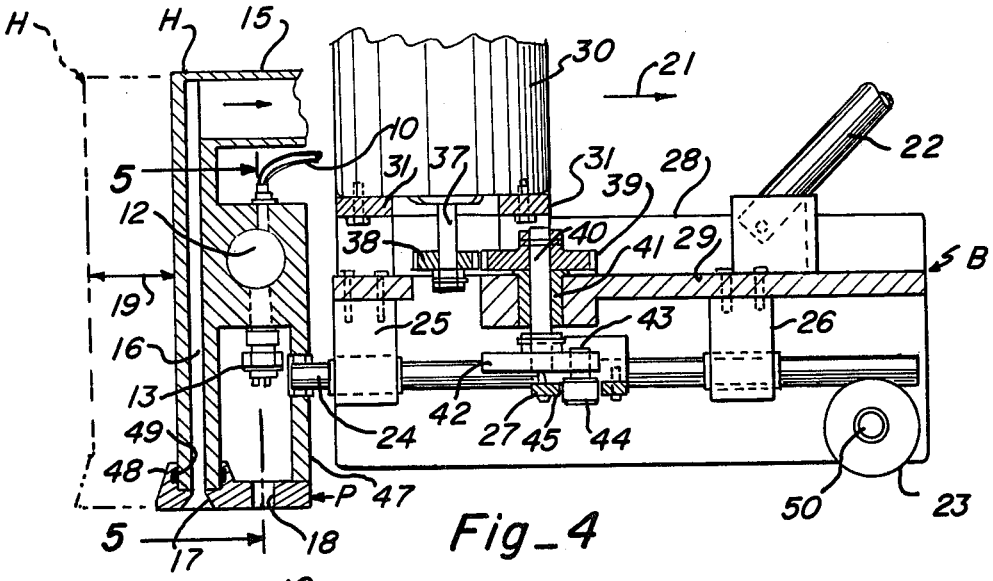
FIG. 4 is a vertical, longitudinally extending cross-section taken along line 4—4 FIG. 3.
Figure 5:
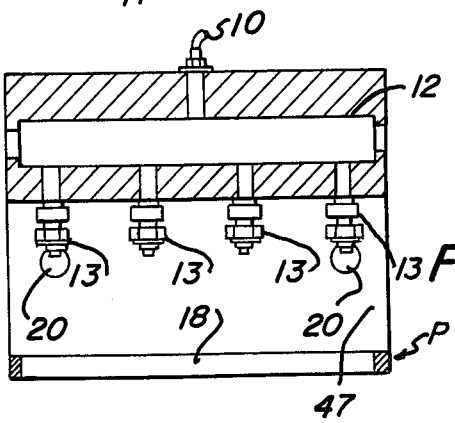
FIG. 5 is a partial transverse, vertical cross-sectional view taken along line 5—5 of FIG. 4.

In general, the apparatus 9 is moved or pulled in a predetermined direction, such as indicated by arrow 21 of FIG. 4 by an elongated handle member 22. A roller means 23 adjacent the opposite edge of body B is used for moving the apparatus 9 to different positions by tipping or pivoting the body B about the roller means 23 so as to move the plate P upwardly off the carpet. Thus, during use of the apparatus 9, the roller means 23 is positioned so as to provide little or no weight upon the carpet until the apparatus 9 is to be moved forwardly to a new starting point for cleaning. The head H is supported, in part, by a pair of reciprocating rods 24 which are mounted in front bearings 25 and rear bearings 26, as well as being clamped to opposite ends of a center plate 27 which is reciprocated forwardly and rearwardly and by the plate P. The body B is provided with side plates 28 to which the elongated handle member 22 is pivotally attached and a mounting plate 29 to which the bearings 25 and 26 are attached.

An electric motor 30 and side plates 28 supply sufficient weight that the inertia of the body B permits the head H to be reciprocated while the body B appears to remain stationary, even though the plate P (which is removably attached to the head H) rests on and peenetrates into the carpet pile. In a preferred embodiment, the mass of the body B is 3½ to about 5 times the mass of the head H and the head H is being reciprocally moved across the fibers of the carpet at a rate of at least about 125 cycles per minute and preferably as high as 585 cycles per minute. The head H is reciprocated over a distance of about ½ to 1 inch. The body B appears to remain stationary but actually reciprocates over a smaller distance of about 1/6 to 1/3 of an inch, preferably, when the mass ratio is 1 to 5, the movement of the body B is about 1/15 to about 1/5 of an inch. In operation, the frictional force between the carpet and the head H is relatively small due to the high rate of the reciprocating motion. The motor 30 preferably has an integral speed reducer and is mounted on motor brackets 31 of FIG. 4 and is supplied with electricity through an electrical cord 32 (see FIG. 1), in which a switch 33 is interposed at a control bracket 34 extending across the opposite sides of said handle member 22, as in FIG. 1. A control valve 35, for controlling the amount of cleaning liquid (or foam) supplied to nozzles 13 is also mounted on bracket 34 and interposed in hose 10. The motor shaft 37 depends from the motor 30, as in FIG. 4, and a pinion 38 is mounted thereon, in registration with a gear 39 mounted on the upper end of a countershaft 40. If desired, a belt and pulley drive may be substituted for the pinion and gear drive, to reduce noise and lubrication problems. On the lower end of countershaft 40, which extends through a sleeve bearing 41 for which a pair of roller bearings or ball bearings may be substituted, is a disc 42 bearing an eccentric or crank pin 43. A ball bearing 44 is mounted on the lower end of crank pin 43, so that during rotational movement of disc 42, ball bearing 44 will move within a rectangular slot 45 in bar or center plate 27. Slot 45 has a width providing a slight clearance for the ball bearing 44 and a length corresponding to the diameter of the circle of travel of the outer edge of all bearing 44. As disc 42 and crank pin 43 rotate, the ball bearing 44 will move from one side of slot 45 to the opposite side and then back again to the first side. As will be evident, during this movement, the bar or center plate 27 and rods 24 with it will be reciprocated and head H will be moved in a reciprocatory manner. Thus, head H will move back and forth between the full position and the dotted position of FIG. 4, the direction of reciprocatory movement being generally parallel with said predetermined direction indicated by arrow 21 in FIG. 4. For illustrative purposes, head H is shown in FIG. 4 at its closest approach to body B, in FIG. 2 at its furthest distance from the body B and in FIG. 3 at an intermediate position in which crank pin 43 is at 90° to its positions in FIGS. 2 and 4.

The head H, in addition to the liquid manifold 12 and the suction manifold 16, which may be integral, includes a preferably integral depending leg 47 which engages the top of one end of plate P. Also, the lower end of the suction manifold 16 extends into a socket formed by an upstanding boss 48, while a gasket 49 is conveniently inserted between the suction manifold 16 and the socket. As indicated previously, the suction slot 17 in plage P may be downwardly divergent. The roller means 23 is provided with an axle 50, as in FIG. 4, while the reduced ends of the axle 50 are mounted in bearings 51 which are attached to the side plates 28 of body B. The roller means 23 may comprise a pair of wheels mounted adjacent one side of said body B.

Figure 10:
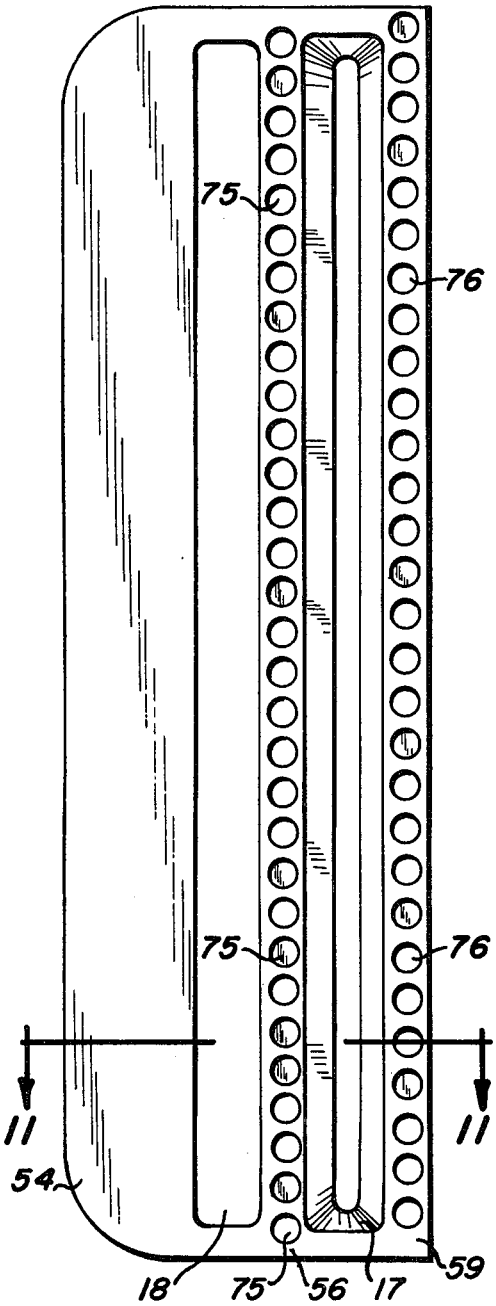
FIG. 10 is a bottom plan view of additional alternative carpet engaging means.

In addition to the suction slot 17 and the liquid slot 18 in plate P, various indentations, such as grooves, slots, cylindrically shaped holes, recesses or the like may be provided recesses 77 in the area 54 and produces a more vigorous scrubbing action on the pile than the plate of FIG. 10, and is adapted for use on shag carpets.

In the alternative embodiment illustrated in FIGS. 14–17, the head H' of apparatus 79 carries only the suction manifold 16' which is attached to a plate P' therebeneath, while the liquid manifold 12' is mounted on the body B', so that the liquid spray nozzles 13 are essentially stationary relative to the reciprocating head H'. The suction hose 11 is connected to the top of the manifold 16' through a hose connection 15, as before, while the "steam" or hot water hose 10 leads to a manifold 12'. The plate P' is again provided with a boss 48 engaged by the lower end of the suction manifold 16', with a gasket 49, of FIG. 17, interposed. The head H' is reciprocated by a pair of rods 24' mounted for reciprocation in bearings 25 and 26 and attached to a plate 27, which may be reciprocated in the manner previously described from a motor 30. The front ends of rods 24' extend into a rearwardly extending boss 80 on the side of manifold 16' facing the rods. The connection between the rods 24' and the respective boss 80 may be through threads, a transverse pin connection, or in any other suitable manner. The head H' is also provided with a pair of ribs 81 which extend downwardly to engage the plate P'. The plate P' may be similar in construction to the plate of FIGS. 6 and 7, being provided with a groove 67 in the area 59 extending completely transversely of the plate P' and parallel slots 63', 64' and 65' in the area 54'.

It will be noted that only the head H' reciprocates, so that the suction nozzle or slot 17 and slots 63', 64' and 65' on the underside of the plate P' will move toward and away from the area of impingement of the liquid from the jets onto the carpet. However, the various grooves 63', 64' and 65' will not only move the fibers back and forth in substantially parallel relationship, but will also tend to produce a scrubbing action on the fibers. Preferably, the amplitude of reciprocation of the head H' is on the order of the amplitude of reciprocation of the previous embodiment.

Figure 3:
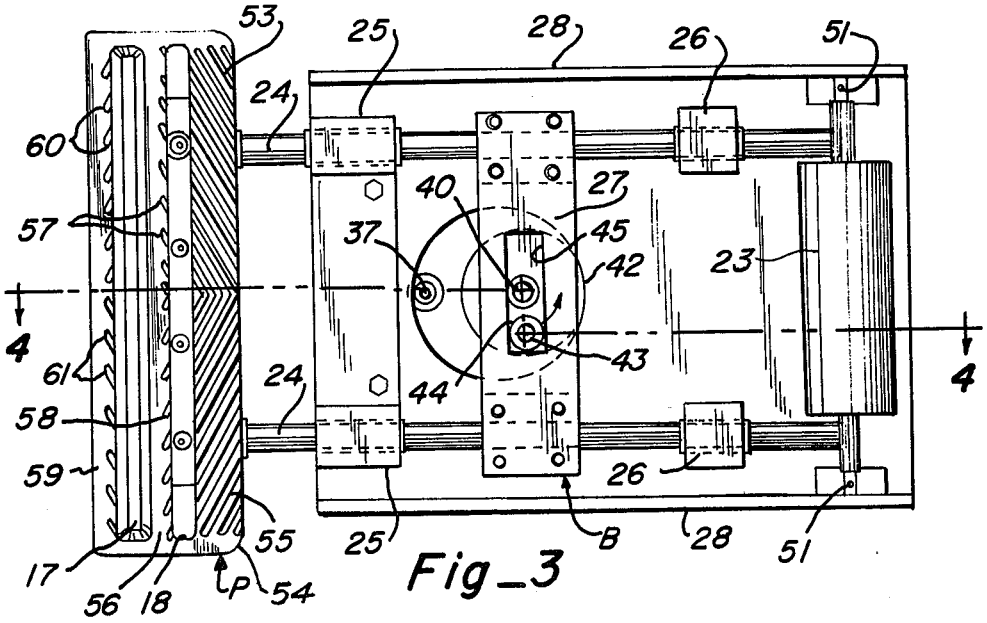
FIG. 3 is a bottom view of the part of the carpet cleaning apparatus of FIG. 2, on an enlarged scale.
Figure 6:
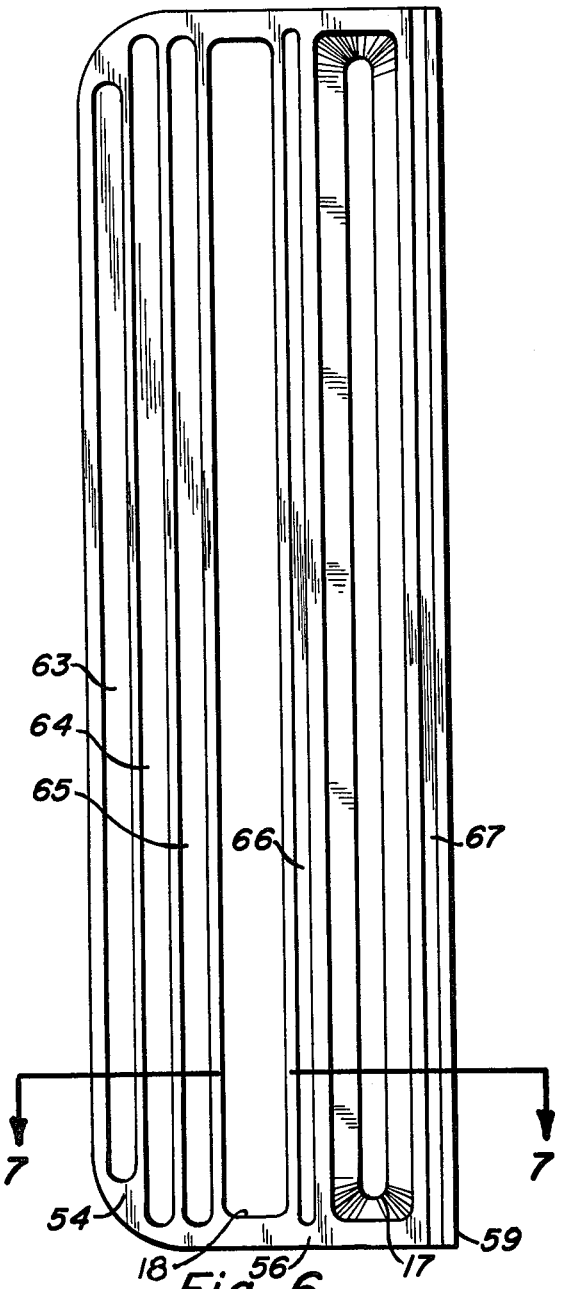
FIG. 6 is a bottom plan view of an alternative carpet engaging means.
Figure 7:
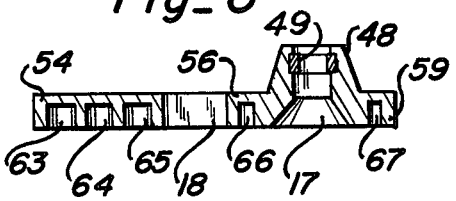
FIG. 7 is a cross-sectional view taken along line 7—7 of FIG. 6.

The lands and grooves on the underside of the plate P may be varied in accordance with the type of rug. For instance, the underside pattern of plate P of FIG. 3 is particularly useful for both short pile and shag carpets. The plate shown in FIGS. 6 and 7 is particularly useful for loose pile carpets, such as shag, since it tends to adhere to tightly woven, short pile carpets. This plate is provided, in addition to suction slot 17 and liquid slot 18 and boss 48, with a series of longitudinal grooves 63, 64 and 65 in the area 54, a longitudinal groove 66 in the area 56 and a longitudinal groove 67 in the area 59. As will be evident, during reciprocation, the grooves will move or pivot the fibers of the pile back and forth in parallel relationship with each other while scrubbing the fibers.

Figure 8:
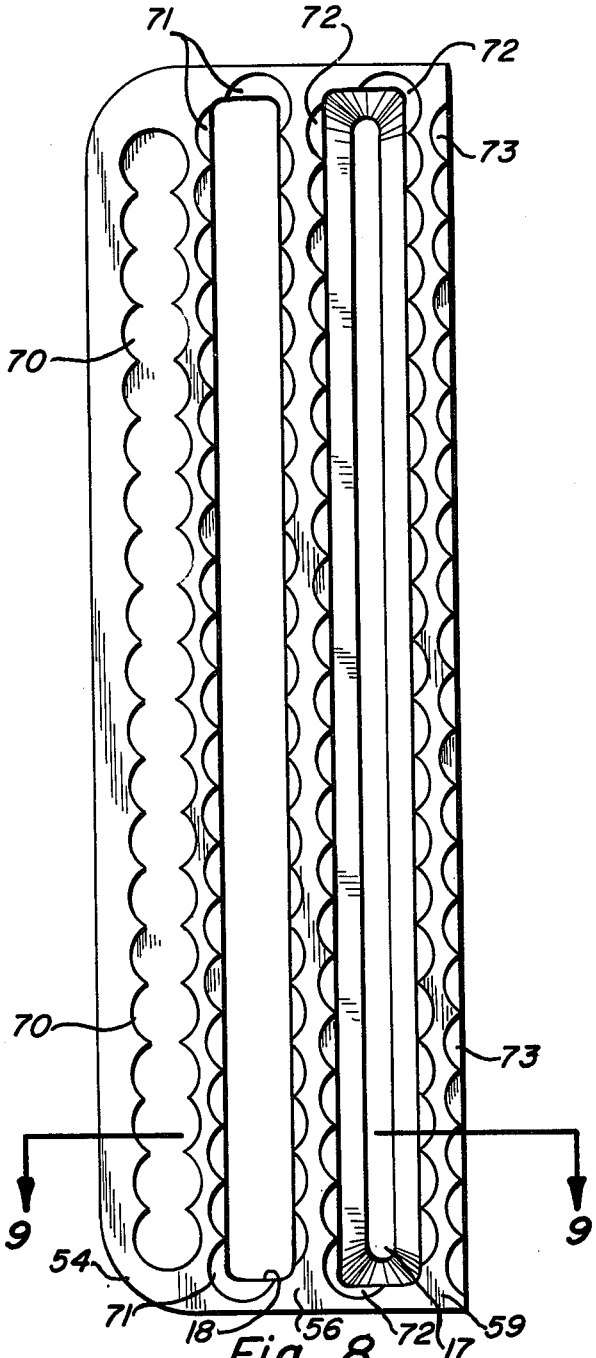
FIG. 8 is a bottom plan view of another alternative carpet engaging means.
Figure 9:
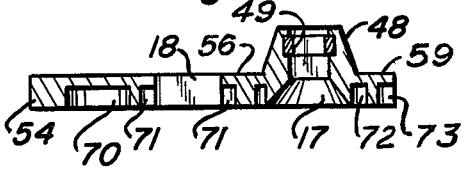
FIG. 9 is a cross-sectional view taken along line 9—9 of FIG. 8.

The plate shown in FIGS. 8 and 9 is particularly adapted to be used with shag rugs. This plate includes a series of intersecting circular grooves 70 in the area 54 to form, in plan view, a plurality of scallop-shaped recesses, with a series of intersecting arcuate grooves 71 on opposite sides of liquid slot 18, a similar series of intersecting arcuate grooves 72 on opposite sides of suction slot 17 and a series of arcuate grooves 73 in the edge of area 59.

Figure 12:
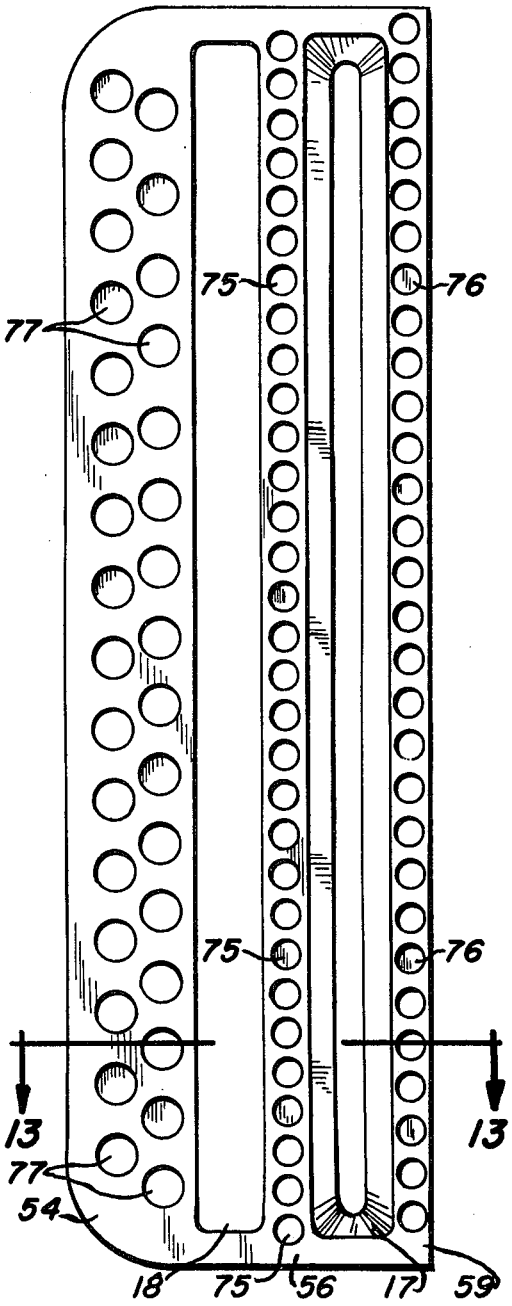
FIG. 12 is a bottom plan view of yet another alternative carpet engaging means.
Figure 11:
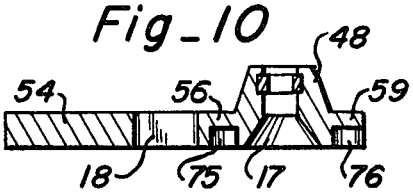
FIG. 11 is a cross-sectional view taken along line 11—11 of FIG. 10.
Figure 13:
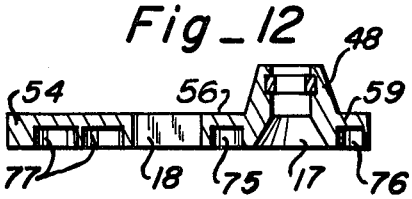
FIG. 13 is a cross-sectional view taken along line 13—13 of FIG. 12.

The plate illustrated in FIGS. 10 and 11 produces a gentler to and fro motion and scrubbing of the fibers and is provided with a row of circular grooves or cylindrically shaped recesses 75 in the area 56 and a row of circular grooves or cylindrically shaped recesses 76 in the area 59. The plate illustrated in FIGS. 12 and 13 is similar to the plate of FIGS. 10 and 11 in having the rows of circular grooves 75 and 76 at the same positions. This plate has a double row of interspaced, circular holes or cylindrically shaped recesses 77 on the underside of plate P so that upon reciprocation of the plate P, the plate P functions as a scrubber bar. The plate shown in FIG. 3 is provided with a series of segmental V-shaped lands and groves along one side of the liquid slot 18 or diagonal slots such as slot 53 extending in one direction on one half of the area 54 between the liquid slot 18 and the adjacent edge of the plate, with oppositely extending diagonal slots 55 on the opposite half of area 54. In the area 56 between the spray clearance or liquid slot 18 and suction slot 17, oppositely inclined, diagonal grooves 57 and 58 may extend from slot 18 toward the suction slot 17. In the area 59 between suction slot 17 and the adjacent edge of plate P, similar grooves 60 and 61 extend in opposite directions to slots 57 and 58 from slot 17 toward the adjacent edge. The diagonal slots 53 and 55, as well as the short diagonal grooves 57, 58 and 60, 61, may have a depth on the order of $\frac{1}{8}$ to $\frac{1}{4}$ inches.

As will be evident, the diagonal slots 53 and 55, as well as the diagonal grooves 57, 58 and 60, 61, tend to engage the pile fibers of the pile or fibers of a rug or carpet, not only moving or pivoting the fibers forwardly and rearwardly in accordance with the direction of movement of plate P during reciprocation, but also engaging the fibers of the pile of the rug and producing, in effect, a scrubbing action. Due to the ability of increasing the amount of weight of the apparatus 9 that can be concentrated on the head H, the plate P will tend to penetrate downwardly into the pile and thus produce superior results, as with long pile carpets of the shag type. The use of oppositely extending lands and grooves minimizes or substantially prevents the apparatus 9 moving other than in a straight line direction. 65' on the underside of the plate P' will move toward and away from the area of impingement of the liquid from the jets onto the carpet. However, the various grooves 63', 64' and 65' will not only move the fibers back and forth in substantially parallel relationship, but will also tend to produce a scrubbing action on the fibers. Preferably, the amplitude of reciprocation of the head H' is on the order of the amplitude of reciprocation of the previous embodiment.

Figure 14:
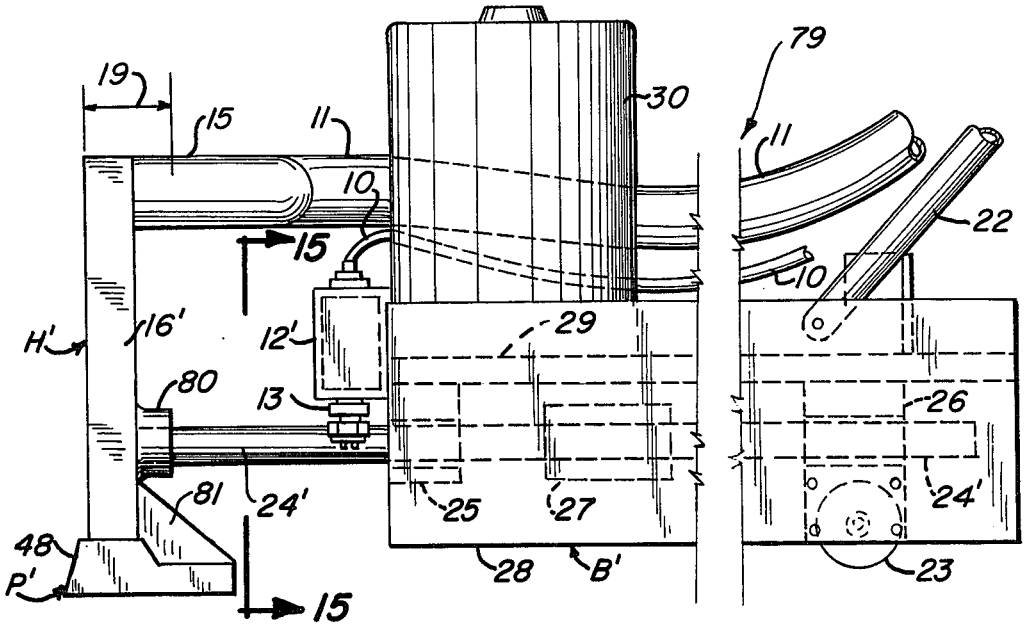
FIG. 14 is a side elevational view of an alternative embodiment of this invention.
Figure 15:
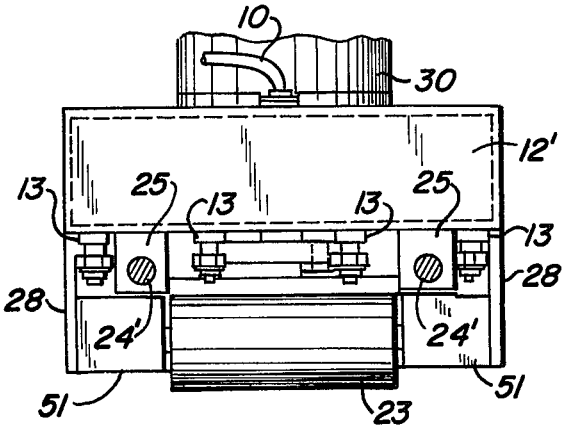
FIG. 15 is a vertical view taken in cross-section along line 15—15 of FIG. 14.
Figure 16:
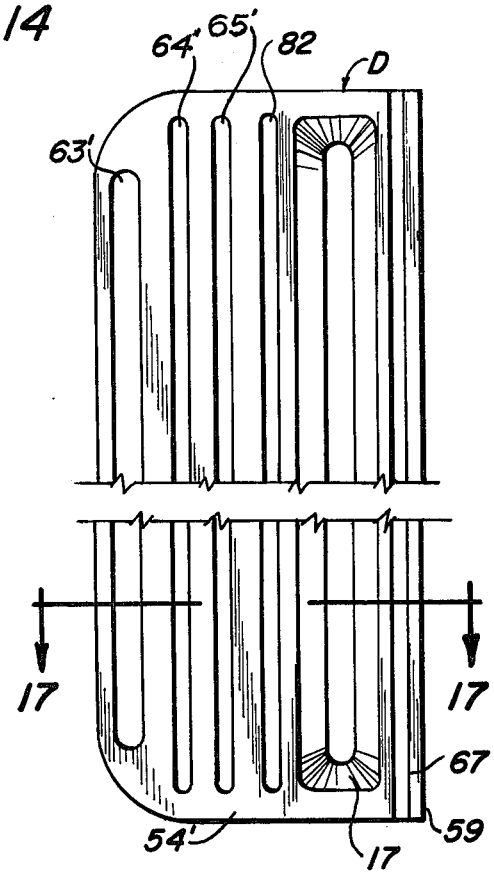
FIG. 16 is a bottom plan view of the carpet engaging means of the apparatus of FIG. 14.
Figure 17:
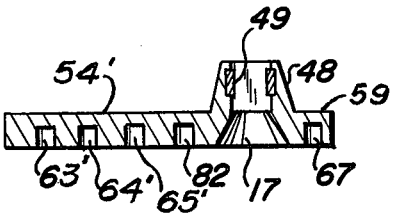
FIG. 17 is a cross-sectional view taken along line 17—17 of FIG. 16.
Figure 18:
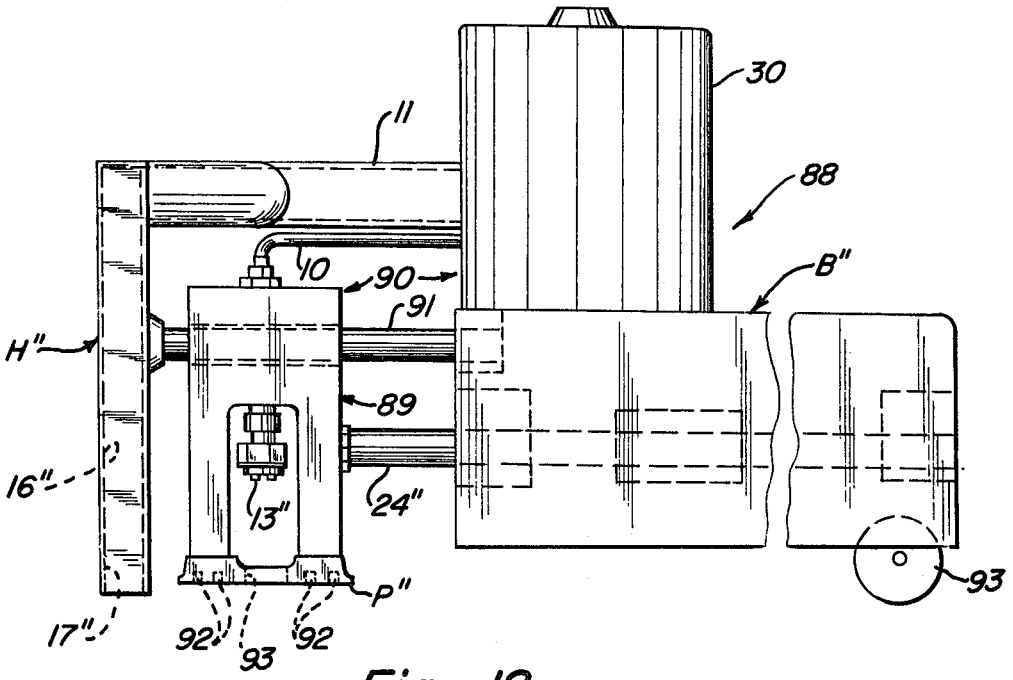
FIG. 18 is a side elevational view of an additional alternative embodiment of the apparatus of this invention.

Still another alternative embodiment of an apparatus 88 constructed in accordance with this invention, said apparatus 88 is shown in FIG. 18 as comprising a head H" and a body B". The head H" is securely mounted to the body B" for nonreciprocatory movement with respect to the body B". A structure 89 is mounted for reciprocatory movement in the direction of the arrow 90 relative to the head H" and the body B". The structure 89 is carried by a pair of horizontally disposed rods 91 (only one of which is shown in FIG. 18). A pair of connecting rods 24" (only one of which is shown in FIG. 18) are attached to one side of the structure 89 and reciprocated in the direction of the arrow 90 in the same or similar manner as described above with respect to the apparatus 9 of FIG. 1. The plate P" and the spray nozzles 13" are securely attached to the structure 89 for reciprocatory movement therewith. A hot water or "steam" hose 10 has one end thereof attached to a liquid manifold (not shown) formed in the structure 89. The lower surface of the plate P" may be configured suitably as desired or required in accordance with the configurations of the plates heretofore or hereinafter described; however, as shown in FIG. 18, the plate P" includes a plurality of transversely extending grooves 92. A slot 93 is formed through the plate P" to permit the liquid being admitted from the spray nozzles 13" to impinge upon the carpet surface. The head H" is attached to a suction hose 11 which is disposed in fluid communication with the suction manifold 16" and the suction slot 17". As shown in FIG. 18, the lower surface portions of the plate P" and the suction slot 17" are disposed in first and second horizontally disposed parallel plane, the plane in which is disposed the lower surface portion of the plate P" being disposed vertically above the other plane by a predetermined amount. The purpose of this arrangement is to facilitate a more efficient removal of the liquid from the carpet thereby reducing the amount of time required for the cleaned carpet to dry thoroughly. With this arrangement, there will be a slight reduction in the amount of scrubbing occurring between the lower surface of the plate P" and the fibers of the carpet. However, satisfactory cleaning results will, nevertheless, be achieved. Although not shown in FIG. 18, the body B" may be supported in the same or similar manner as the apparatus 9 of FIG. 9 or as shown in FIG. 14 for apparatus 79. It will be noted that the body B" of the apparatus 88 shown in FIG. 18 is supported by a pair of wheels 93 (only one of which is shown) mounted adjacent the right side of the body B". Additionally, the lower surface of the plate P" and the lower most portion of the wheels 93 are disposed in a single horizontally extending plane. It will be obvious from the herein-description that the structure 89 and its attached, but removable plate P" reciprocates relative to both the head H" and the body B".

Figure 19:
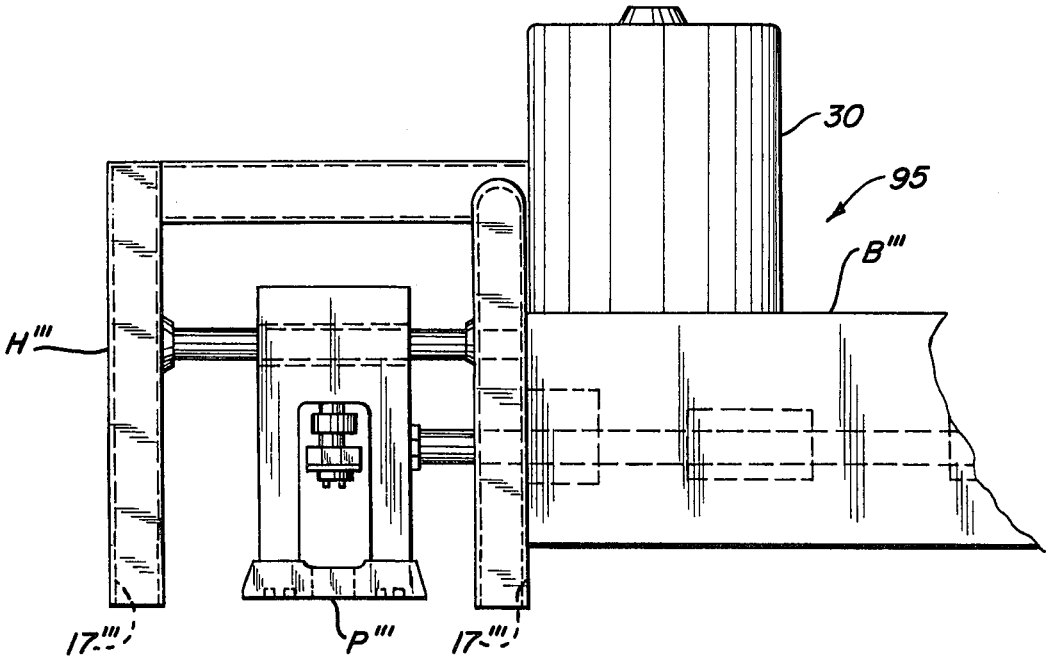
FIG. 19 is a side elevational view of another alternative embodiment of an apparatus constructed in accordance with this invention.
Figure 20:
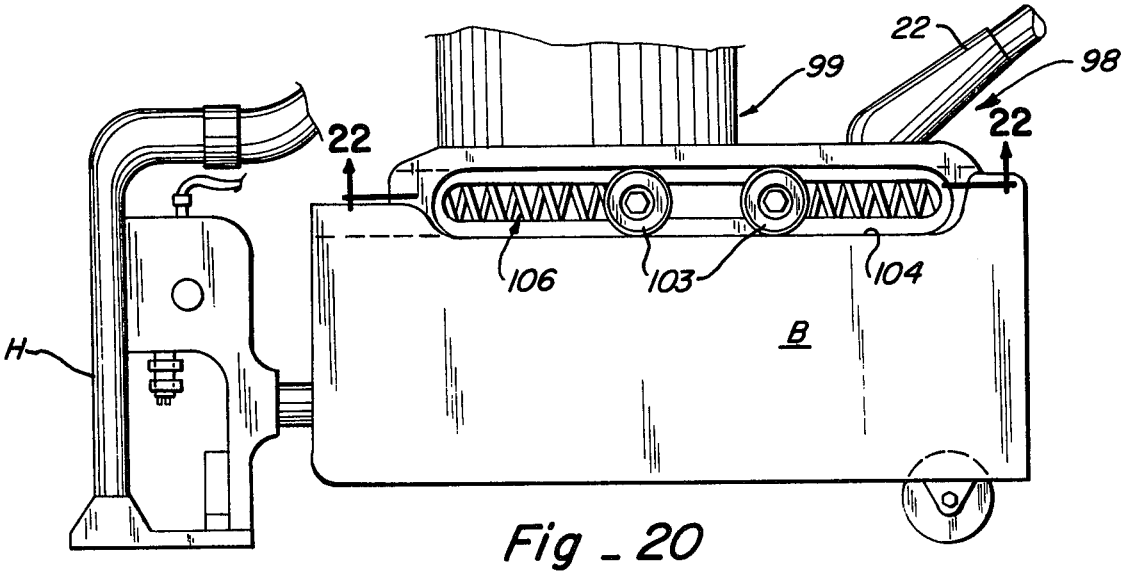
FIG. 20 is a side elevational view of a handle system for an apparatus constructed for self-propulsion through reciprocation of a part of said apparatus along a support surface.
Figure 22:
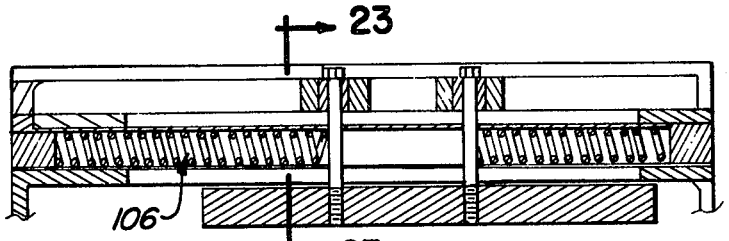
FIG. 22 is a cross-sectional view taken along line 22—22 of FIG. 20.
Figure 23:
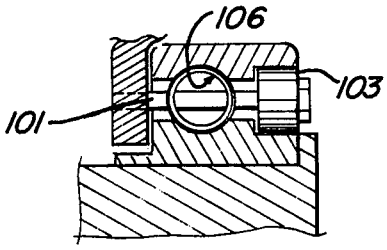
FIG. 23 is a cross-sectional view taken along line 23—23 of FIG. 22.
Figure 21:
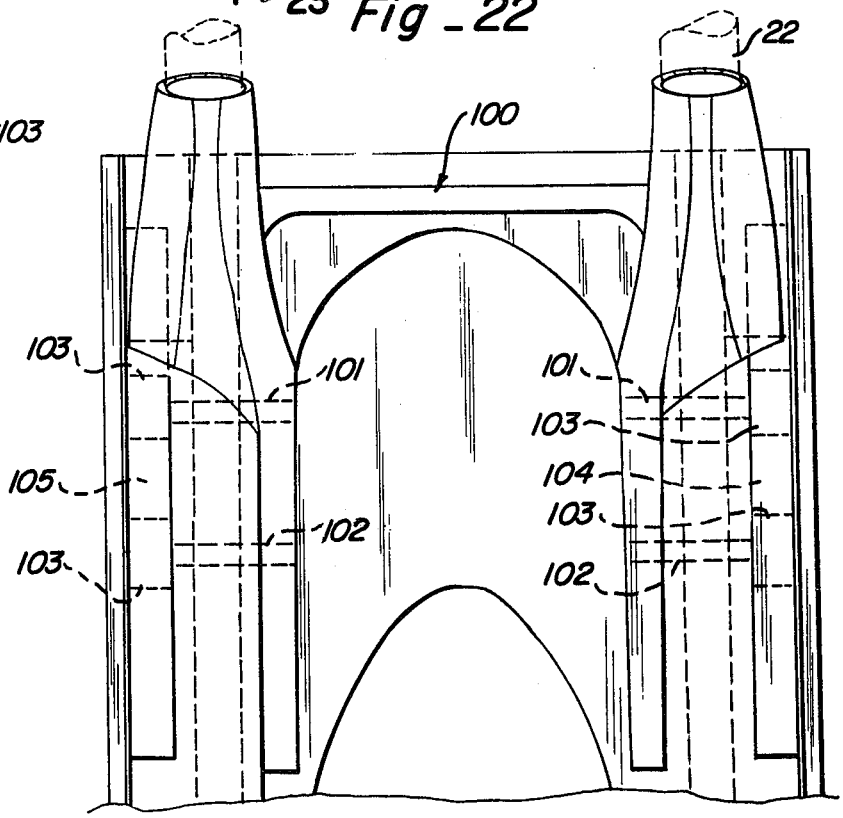
FIG. 21 is a partial plan view of the handle system shown in FIG. 20.

The apparatus 95 of FIG. 19 is somewhat similar in construction to the apparatus 88 of FIG. 18. However, apparatus 95 includes a pair of spaced apart suction slots 17''' which are disposed in fluid communication with a source of reduced pressure as compared to the ambient pressure. Additionally, the plate P''' of the apparatus 95 has a lower surface thereof disposed in the same plane in which lies the lower surfaces of the suction slots 17'''.

In FIGS. 20–23 is shown a handle system 98 incorporated within an apparatus 99 constructed for self-propulsion through reciprocation of a part of said apparatus 99 along a support surface. The handle system comprises a generally U-shaped member 100 having first and second pairs of aligned trunnions 101 and 102 extending laterally outwardly from the sides of said U-shaped member 100. Each pair of aligned trunnions is longitudinally spaced one from the other along the longitudinal axis of the U-shaped member. Each of the trunnions has a free end upon which is mounted a means 103 for supporting said free end. Said handle system 98 also includes an elongated handle member 22 attached to the U-shaped member 100 and extending upwardly therefrom at a predetermined angle of inclination. The apparatus 99 has a housing in which is formed a pair of elongated guide slots 104 and 105. Each guide slot is adapted to receive and support therein the means 103 for supporting each of the free ends of the trunnions which extend laterally outwardly from one of the sides of the U-shaped member 100. The U-shaped member 100 is generally disposed between said guide slots 104 and 105. The means 103 for supporting the free ends of the colinearly aligned pair of trunnions are mounted for reciprocatory movement within said guide slots. The handle system 98 also includes means 106 for biasing said U-shaped member 100 to a predetermined position whereby upon movement of the housing of apparatus 99 relative to said U-shaped member 100, said biasing means 106 will restore said U-shaped member to said predetermined position. The means 103 for supporting the free ends of the aligned trunnions includes a roller member mounted on the free end of said trunnions. The biasing means 106 includes compression coil springs one end of each which engages a respective one of said trunnions and the other end of which engages a portion of the housing of the apparatus 99.

Based upon the above description, it should now be readily apparent that the handle system 98 of this invention facilitates control of the apparatus 99 with a relatively minimum amount of effort even though the head H (which may be similar or identical to the head H shown in FIG. 1) is reciprocating a relatively rapid rate, at least approximately 120 cycles per minute and preferably at the rate of approximately 585 cycles per minute with respect to the body B of the apparatus 99, said body B of apparatus 99 being illustrated as similar to the body B of apparatus 9 shown in FIG. 1. More specifically, the biasing means 106 acts as a buffer and absorbs or attenuates the vibratory forces which would otherwise be transmitted to the handle member 22. This feature reduces or substantially eliminates the operator of the apparatus from becoming fatigued.

Figure 24:
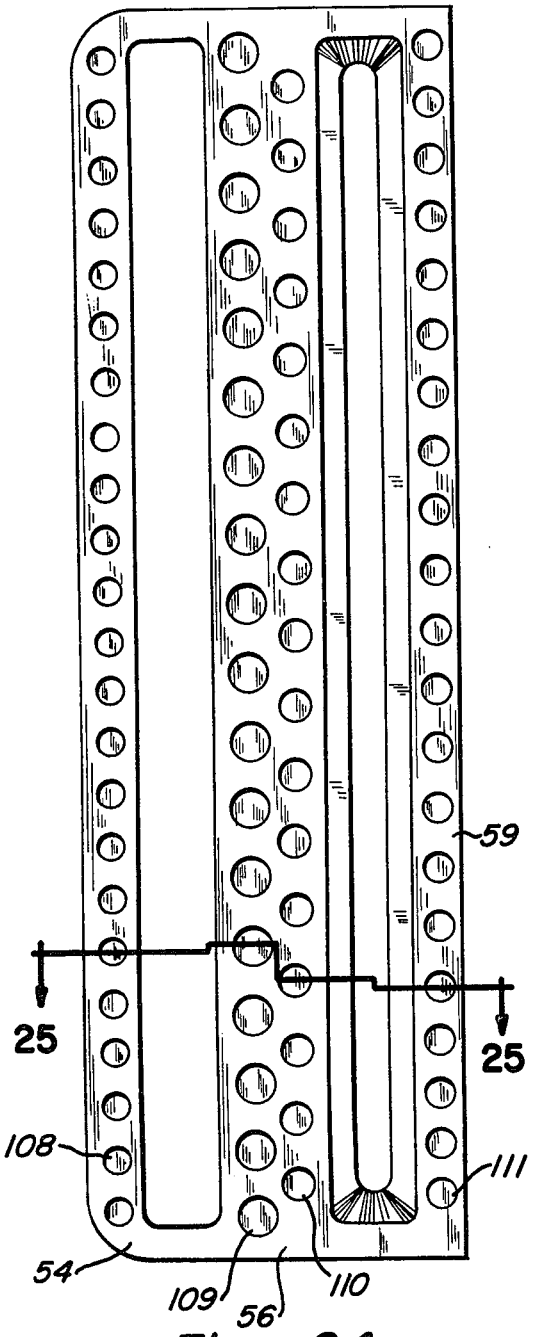
FIG. 24 is a bottom plan view of another alternative carpet engaging means.
Figure 25:
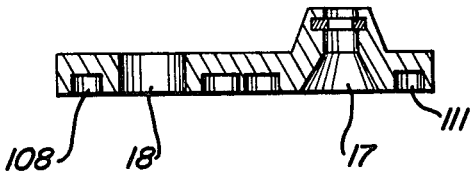
FIG. 25 is a cross-sectional view taken along line 25—25 of FIG. 24.

In FIGS. 24 and 25 is shown another plate which may be used with an apparatus constructed in accordance with this invention. The plate of FIGS. 24 and 25 is, like all of the other plates shown and described herein, preferably removably mounted to the apparatus of this invention. The purpose for this is to permit a single apparatus to be used in cleaning many different types of carpets merely by removing and installing a plate which is most suitable for the fibers and pile of the carpet involved. The plate shown in FIGS. 24 and 25 includes a plurality of rows 108, 109, 110 and 111 formed in the lower surface thereof. More specifically, row 108 is formed in area 54, rows 109 and 110 are formed in area 56 and row 111 is formed in area 59. The plate of FIGS. 24 and 25 includes a suction slot 17 and a liquid slot 18. The lower surface portion of the plate shown in FIGS. 24 and 25 has a relatively large surface area that comes into contact with the carpet. As a consequence, the cleaning or scrubbing action of this plate is somewhat less than those plates the lower surface portion of which has a somewhat smaller area coming into contact with the carpet. Additionally, it will be noted that the lower surface portion of the plate shown in FIGS. 24 and 25 has fewer straight edges than most of the other plates disclosed and described herein. This contributes to a somewhat lessened cleaning or scrubbing action of the fibers of the carpet. The plate shown in FIGS. 24 and 25 is designed for use with a carpet having a tight woven, cut pile. The user of this type of plate for such carpet reduces operator fatigue. Additionally, it is believed that the plate of FIGS. 24 and 25 is preferred when training new operators in the use of an apparatus constructed in accordance with this invention.

Figure 26:
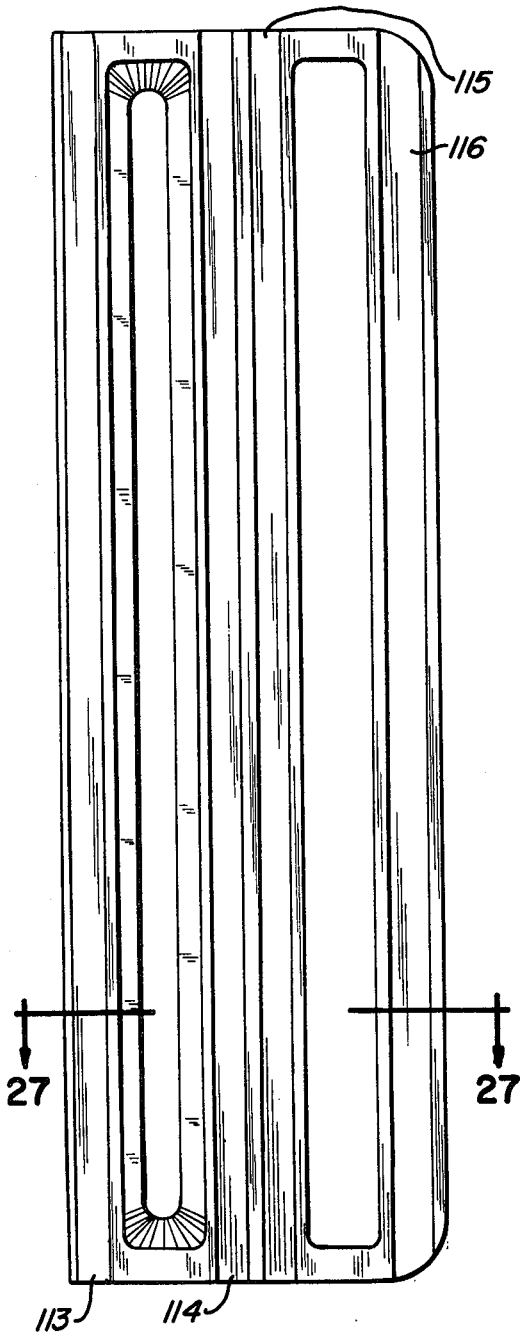
FIG. 26 is a bottom plan view of an additional alternative carpet engaging means.
Figure 27:
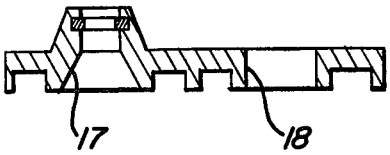
FIG. 27 is a cross-sectional view taken along line 27—27 of FIG. 26.

The plate of FIGS. 26 and 27 includes a suction slot 17, a liquid slot 18 and a plurality of transversely extending grooves 113, 114, 115 and 116 which extend completely across or laterally of said plate. Thus, the suction slot of the plate of FIGS. 26 and 27 includes a pair of laterally extending grooves one of each being laterally disposed along one of the sides of said slot. The liquid slot 18 likewise includes a pair of laterally extending grooves 115 and 116 one of which is disposed laterally along one of the sides of the slot 18. The plate of FIGS. 26 and 27 is a general purpose plate that can be effectively used on almost any type of carpet. Excellent cleaning results are obtained through the use of the plate shown in FIGS. 26 and 27 while, at the same time, leaving the fibers of the carpet in an appealing aesthetic appearance. It will be noted that the plate of FIGS. 26 and 27 includes a plurality of straight edges or agitating edges (disposed at right angles to the direction of reciprocatory movement of the plate). At the present time, the plate of FIGS. 26 and 27 is the preferred plate for use with an apparatus constructed in accordance with the subject invention.

Figure 28:
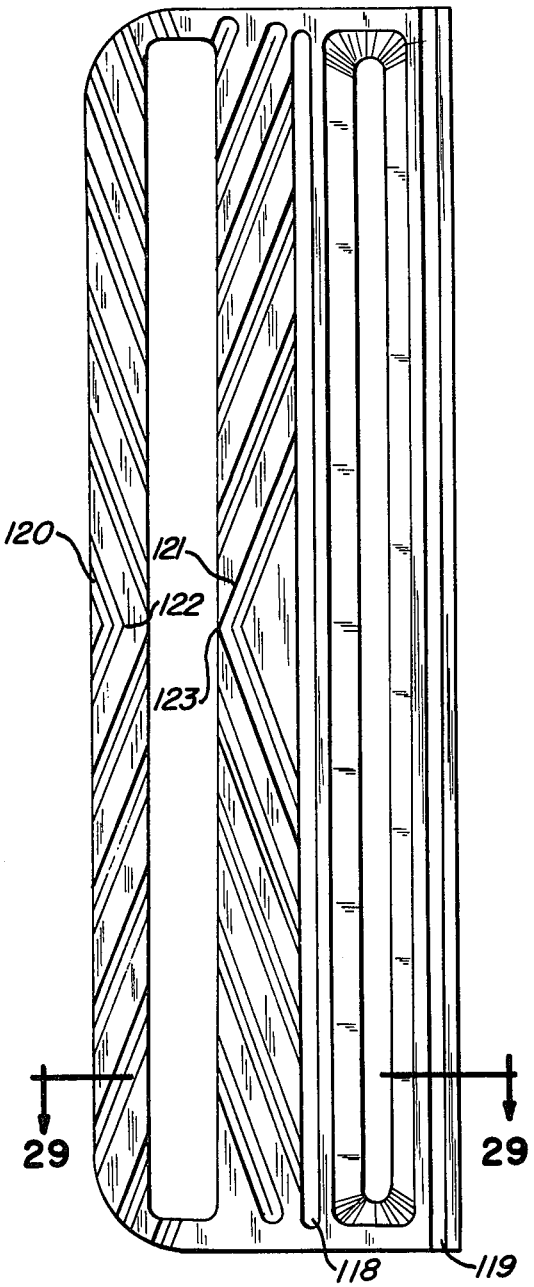
FIG. 28 is a plan view of an additional alternative carpet engaging means.
Figure 29:
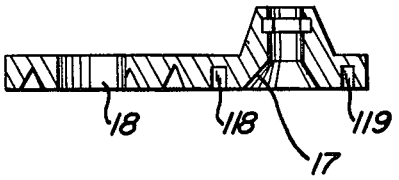
FIG. 29 is a cross-sectional view taken along line 29—29 of FIG. 28.

The plate of FIGS. 28 and 29 includes a suction slot 17 and a liquid slot 18. The suction slot 17 has a laterally extending groove 118 and 119 formed along each side thereof. The groove 119 extends completely across the plate. The plate of FIGS. 28 and 29 has scrubbing means formed in the lower surface portion thereof including segmental V-shaped lands and grooves 120 and 121 formed along each side of the liquid slot 18 and extending generally parallel with the longitudinal axis of the slot 18. The V-shaped lands and grooves 120 and 121 have the apex 122 and 123 of the middle segmental V-shaped land and groove disposed along a respective one of the sides of slot 18 at the middle portion thereof. The segmental V-shaped lands and grooves form an included angle with the longitudinal axis of the slot 18 varying between approximately 10 and 20 degrees. The segmental V-shaped lands and grooves preferably form an included angle with the longitudinal axis of said slot 18 of approximately 20°. The plate of FIGS. 28 and 29 is effective in providing a high degree of cleaning or scrubbing action against the fibers of the carpet due to the large number of straight edges formed in the lower surface portion thereof. The plate of FIGS. 28 and 29 can be used effectively with a large number of carpet types. However, it is not generally used with a looped pile due to the undersirable results occurring sometimes between the ends of the straight edges of the V-shaped lands and grooves snagging or being caught by one of the looped portions of the pile. The use of V-shaped lands and grooves on the lower surface portion of the plate of FIGS. 28 and 29, as well as with the plate of FIG. 3, achieve an improved cleaning action over some of the other plates described and disclosed herein due to the movement of the fibers of the carpet during the reciprocatory movement of the plate. More specifically, the fibers of the piles are not only pivoted about the bottom portion thereof, but also are rotated about their longitudinal axis thereby presenting an increased surface area of each fiber to the cleaning or scrubbing action of the plate during reciprocation thereof.

This invention also relates to a system for propelling an apparatus across a carpet where said apparatus involves first and second parts (the body B and the head H) at least one (the head H) of which is movable in a linear direction relative to the other (the body B). The propelling system includes means 23 for supporting the first part (body B) of the apparatus 9, said means including a roller means, means for supporting the second part (the head H) of said apparatus 9, said means including a carpet engaging surface portion (the lower surface portion of the plate P), and means for propelling the apparatus 9 across a carpet. The propelling means includes means for applying a first force to the second part (the head H) to move said second part relative to the first part (the body B) in a linear direction until the carpet engaging surface of the second part (the lower surface portion of the plate P which is removably attached to the head H) engages the carpet in such a manner that further movement of said carpet engaging surface relative to the second part (the head H) is prevented. This occurs when the forward or leading edge of the lower surface of the plate P is driven downwardly to the fibers of the carpet by a sufficient amount that further movement thereof relative to the fibers of the carpet is effectively precluded. The means for propelling said apparatus continues to apply said first force until the roller means supported part (the body B) moves away from the carpet engaging surface supported part (the head H) by a predetermined amount. As explained above in connection with the reciprocation of the head H relative to the body B, the force involved herein is supplied by the motor acting through the hereinabove described parts used to drive the connecting rods 24 in a reciprocating manner. The means for propelling said apparatus 9 also applies a second force to move the carpet engaging surface supported part (the head H) towards the roller means supported part (the body B). This involves the reversal in direction of movement of the connecting rods 24. Upon reversing the direction of movement of the connecting rods 24 (following relative movement of the head H and the body B at their remotest position one from the other) the head H is moved towards the body B as described above. The system for propelling the apparatus 9 includes, understandably, means for sequentially applying said first and second forces at a rate of at least approximately 125 times per minute and, preferably, at a rate of at least approximately 585 times per minute.

Although heretofore previously referred to in an incidental manner, it will be noted that the suction slot 17 and the liquid slot 18 may be simultaneously reciprocated relative to the body B or the liquid slot 18 may be reciprocated relative to the suction slot 17.

The method of cleaning a carpet in accordance with this invention is now described. Said method includes a loosening soiling material from the carpet and entraining said soiling material in a cleaning liquid by applying a cleaning liquid through the spray nozzles 13 to a portion of the carpet, and aligning the fibers of the pile of the carpet relative to each other and pivoting said fibers about a point adjacent their lower ends by repeatedly reciprocating a fiber engaging surface portion across the fibers while moving said fiber engaging surface portion in a predetermined direction (such as the direction indicated by arrow 21 in FIG. 4) along the upper surface of the carpet, said reciprocatory movement of said fiber engaging surface portion being in a direction generally parallel with said predetermined direction, and cleaning the carpet by repeatedly subjecting the aligned fibers to a pressure less than the ambient pressure thereby removing from said fibers at least a portion of the loosened and entrained soiling material in the liquid previously applied to the carpet. The carpet is subjected to a pressure less than the ambient pressure when the suction slot 17 is connected in fluid communication to the vacuum side of a pump or the like. The method of this invention includes also simultaneously rotating the fibers of the pile of the carpet about their longitudinal axis while aligning and pivoting the fibers about a point adjacent the lower ends thereof. The method of this invention includes reciprocating the fiber engaging surface portion at a rate of at least approximately 120 cycles per minute and preferably at a rate of at least approximately 585 cycles per minute.

Another embodiment of the method of this invention comprises treating the carpet by applying a cleaning liquid to a portion thereof, such as emitting liquid from the spray nozzles 13 through the liquid slot 18 onto the carpet, loosening soiling material from the carpet and entraining soiling material in the cleaning liquid by repeatedly reciprocating a fiber engaging surface portion along the surface of the liquid treated portion of the carpet in a predetermined direction while maintaining said fiber engaging surface portion in a continuous contact with the treated portion of the carpet, said reciprocatory movement of said fiber engaging surface portion to moving in a direction generally parallel with said predetermined direction, and cleaning the carpet by subjecting the treated carpet to a pressure less than the ambient pressure thereby removing a portion of the loosened and entrained soiling material and the liquid previously applied to the carpet.

Another alternative embodiment of the method of this invention for cleaning a carpet comprises applying a cleaning liquid to a portion of the carpet, repeatedly reciprocating a fiber engaging surface portion across the surface of a portion of the carpet to which a cleaning liquid has been applied, simultaneously removing the fiber engaging surface portion in a predetermined direction along the surface portion of the carpet to which the liquid has been applied, said reciprocatory movement of said fiber engaging surface portion being in a direction generally parallel with said predetermined direction, and cleaning the carpet by subjecting the treated carpet to a pressure less than the ambient pressure thereby removing a portion of the cleaning liquid previously applied to the carpet.

This invention also relates to a method for propelling an apparatus across a carpet comprising constructing an apparatus having two parts one of which is movable in a linear direction relative to the other, one of said parts having support means including a roller means and the other of said parts having support means including a carpet engaging surface, supporting said apparatus on a carpet by said support means, propelling said apparatus across a carpet by a predetermined amount by applying a first force to move the carpet engaging surface supported part relative to the roller means supported part in a generally linear direction until the carpet engaging surface supported part engages the carpet with sufficient friction to prevent further movement of said carpet engaging surface supported part relative to the carpet, continuing the application of said first force until the roller means supported part moves away from the carpet engaging surface supported part by a predetermined amount and applying a second force to move the carpet engaging surface supported part towards the roller means supported part, and continuing to propel said apparatus by repeating the propelling step.

An alternative method for propelling an apparatus across a carpet comprising constructing an apparatus having two parts one of which is movable in a linear direction relative to the other, the ratio of masses of one of said parts to the other of said parts equalling at least approximately 2½ or more, the part having the smaller mass having a support means including a carpet engaging surface, during use supporting said apparatus, at least in part, on a carpet by said carpet engaging surface, propelling said apparatus across a carpet by a predetermined amount by applying a first force between said parts to move the carpet engaging surface supported part relative to the part having the larger mass in a generally linear direction until the carpet engaging surface supported part engages the carpet with sufficient friction to prevent further movement of said carpet engaging surface supported part relative to the carpet, continuing the application of said first force until the part having the larger mass moves away from the carpet engaging surface supported part by a predetermined amount, and applying a second force between said parts to move the carpet engaging surface supported part toward the part having the larger mass, and continuing to propel said apparatus by repeating the propelling step. Preferably, the ratio of masses of the two parts equals at least approximately 3½ times or more, and excellent results have been obtained where the ratio of the masses of the two parts varies between 4 and 5. For example, the head of one of the embodiments of this invention weighs approximately 4.54 kilograms (10 pounds) while the body weighs approximately 18.14 kilograms (40 pounds). However, depending upon the technique used in constructing the head and the body and the materials used therein, it is to be understood that the ratio of the masses may vary as set forth above without departing from the spirit and scope of this invention. It will also be understood that the rate of propulsion increases as the ratio of the masses increase from approximately 2.5 to 5, and the rate of propulsion also varies with respect to the rate of reciprocation of the parts relative to each other, the rate increasing as the rate of reciprocation increases.

This invention also relates to a system for propelling an apparatus across a carpet wherein said apparatus has first and second parts at least one of which is movable in a linear direction relative to the other. The system comprises a first part of said apparatus, preferably supported by roller means, a second part of said apparatus supported on said carpet by means including a carpet engaging surface portion, the ratio of masses of the first part of said apparatus to the second part of said apparatus equalling at least approximately 2½ times or more and preferably 3½ times or more, and means for propelling said apparatus across a carpet, said propelling means including means for applying a first force between said first and second parts to move said second part relative to the first part in a linear direction until the carpet engaging surface portion of said second part engages the carpet to prevent further movement of said carpet engaging surface portion relative to the second part, said means continuing the application of said first force until the first part moves away from the second part by a predetermined amount, and said means further applying a second force between said first and second parts to move the second part toward the first part.

In view of the foregoing, it will be readily appreciated that unique and novel methods and apparatuses have been disclosed and described herein. The method and apparatus of this invention for cleaning a carpet produces superior results to any method or apparatus heretofore known to the inventor. Moreover, the method and apparatus of this invention may be operated and used by a single person, and the apparatus of this invention may be operated for long periods of time without the operator becoming unnecessarily fatigues or wornout. The life of the carpet which is cleaned by the method and apparatus of this invention is greatly extended since it is now possible to remove soiling material from the base of the fibers of the carpet easily and quickly, something which heretofore has not been possible to do or, if possible, without subjecting the carpet to excessive abrasive wear.

At the present time, the apparatus of FIG. 1 when combined with the plate of FIGS. 26 and 27 and the handle system of FIGS. 20–23 is the preferred embodiment of this invention. Additionally, at the present time, the preferred method for cleaning a carpet in accordance with this invention is the method involved in the use of the apparatus 9 of FIG. 1.

Although different embodiments and methods of this invention have been illustrated and described and variations thereof indicated, it will be understood that other embodiments may exist and that various changes may be made, all without departing from the spirit and scope of this invention.

I claim:

1. A carpet cleaning apparatus constructed for movement across a carpet in a predetermined direction, said apparatus comprising:

(a) means for engaging the fibers of the pile of a carpet and directing a cleaning fluid to a portion of the carpet, said means being connectible in use with a source of cleaning liquid, said means extending laterally of said predetermined direction, (b) a suction manifold, said suction manifold being connectible when in use with a source of suction, (c) a laterally extending nozzle disposed in fluid communication with said suction manifold for applying suction to said carpet, said nozzle being spaced from said means for engaging the fibers of the carpet in a direction generally parallel to said predetermined direction, (d) a body member, (e) a head member carrying at least one suction manifold and said laterally extending nozzle, said head member being mounted for movement toward and away from said body member, (f) means supporting said head member from said body member, and (g) means mounted on said body member for reciprocating said head member and support means for the head member relative to said body member.

2. A carpet cleaning apparatus constructed for movement across a carpet in a predetermined direction, said apparatus comprising:

(a) means for engaging the fibers of the pile of a carpet and directing a cleaning fluid to a portion of the carpet, said means being connectible in use with a source of cleaning fluid, said means for extending laterally of said predetermined direction, said means further having a fiber engaging surface portion with segmental V-shaped lands and grooves formed therein, said fiber engaging surface portion having a slot therethrough for conveying cleaning fluid to a portion of the carpet, said slot having two sides extending along a longitudinal axis disposed substantially normal to said predetermined direction, said segmental V-shaped lands and grooves extending along a portion of one side of said slot, said V-shaped lands and grooves having the apex of the middle segmental V-shaped land and groove disposed along one side of said slot at the middle portion thereof, (b) a suction manifold said suction manifold being connectible in use with a source of suction, (c) a laterally extending nozzle disposed in fluid communication with said suction manifold for applying suction to said carpet, said nozzle being spaced from said means for engaging the fibers of the carpet in a direction generally parallel to said predetermined direction, (d) a body member, (e) a head member carrying at least said suction manifold and said laterally extending nozzle, said head member being mounted for movement toward and away from said body member, (f) means supporting said head member from said body member, and (g) means mounted on said body member for reciprocating moving said head member and support means for the head member relative to said body member.

3. The apparatus as defined in claim 2 in which said segmental V-shaped lands and grooves form an included angle with the longitudinal axis of said slot varying between approximately 10° and 20°.

4. The carpet cleaning apparatus of claim 1 wherein said head member further carries said fiber engaging means.

5. The carpet cleaning apparatus of claim 1 wherein said fiber engaging means has a fiber engaging surface portion, said fiber engaging surface portion having a slot therethrough for conveying cleaning fluid to a portion of the carpet, said slot having two sides extending along a longitudinal axis disposed substantially perpendicularly to said predetermined direction, said fiber engaging surface portion having a pair of grooves formed therein, one of said pair of grooves extending longitudinally along one of the sides of said slot and spaced from said one side.

6. The carpet cleaning apparatus of claim 1 wherein said fiber engaging means has a fiber engaging surface portion, said fiber engaging surface portion having a slot therethrough for conveying cleaning fluid to a portion of the carpet, said slot having two sides extending along a longitudinal axis disposed substantially perpendicularly to said predetermined direction, said fiber engaging surface portion including a plurality of scallop-shaped recesses formed therein along at least one side of said slot.

7. The carpet cleaning apparatus of claim 6 wherein said fiber engaging surface portion includes a plurality of scallop-shaped recesses formed along the second side of said slot.

8. The carpet cleaning apparatus of claim 1 wherein said fiber engaging means has a fiber engaging surface portion, said fiber engaging surface portion having a slot therethrough for conveying cleaning fluid to a portion of the carpet, said slot having two sides extending along a longitudinal axis disposed substantially perpendicularly to said predetermined direction, said fiber engaging surface portion having a plurality of recesses formed along opposite sides of said slot, each recess being disposed in fluid communication with said slot.

9. The carpet cleaning apparatus of claim 1 wherein said laterally extending nozzle has a surface portion having a slot formed therethrough, said slot having two sides extending along a longitudinal axis disposed substantially normal to said predetermined direction, said surface portion of said nozzle having a pair of grooves formed therein, one of said pair of grooves extending longitudinally along one of the sides of said slot and spaced from said one side.

10. The carpet cleaning apparatus of claim 1 wherein said laterally extending nozzle has a surface portion having a slot formed therethrough, said slot having two sides spaced from each other and extending along a longitudinal axis disposed generally normal to said predetermined direction, said surface portion having a plurality of scallop-shaped recesses formed therein along one side of said slot.

11. The carpet cleaning apparatus of claim 1 wherein said laterally extending nozzle has a surface portion having a slot formed therethrough, said slot having a longitudinal axis disposed generally normal to said predetermined direction, said surface portion having a plurality of recesses formed along opposite sides of said slot, each recess being disposed in fluid communication with said slot.

12. The carpet cleaning apparatus of claim 1 wherein said reciprocating means moves said head member toward and away from said body member along a path at a rate of a least approximately 125 cycles per minute.

13. The carpet cleaning apparatus of claim 1 wherein said reciprocating means moves said head member toward and away from said body member along a path at a rate of at least approximately 585 cycles per minute.

* * * * *